US010524984B2

(12) United States Patent
Graska et al.

(10) Patent No.: US 10,524,984 B2
(45) Date of Patent: Jan. 7, 2020

(54) APPARATUS AND METHOD FOR DISPENSING MEDICATION FROM A MOBILE COMMUNICATON DEVICE

(71) Applicant: Case.MD, Ravenna, OH (US)

(72) Inventors: Samuel Christopher Graska, Ravenna, OH (US); Justin Rudy Gleason, Ravenna, OH (US)

(73) Assignee: CASE.MD, Ravenna, OH (US)

( * ) Notice: Subject to any disclaimer, the term of this patent is extended or adjusted under 35 U.S.C. 154(b) by 211 days.

(21) Appl. No.: 15/481,700

(22) Filed: Apr. 7, 2017

(65) Prior Publication Data

US 2018/0289590 A1 Oct. 11, 2018

(51) Int. Cl.
*A61J 7/00* (2006.01)
*A61J 7/04* (2006.01)

(52) U.S. Cl.
CPC ..... *A61J 7/0076* (2013.01); *A61J 7/0418* (2015.05); *A61J 2200/30* (2013.01)

(58) Field of Classification Search
CPC ..... A61J 7/0418; A61J 7/0427; A61J 7/0445; A61J 7/0472; A61J 7/0481
USPC ..... 221/1, 197, 25, 26, 7, 3, 15, 76
See application file for complete search history.

(56) References Cited

U.S. PATENT DOCUMENTS 3,143,207 A * 8/1964 Wagner ..... A61J 7/04 206/533
3,437,236 A * 4/1969 Huck ..... B65D 83/0454 206/534
3,831,808 A * 8/1974 Bender ..... A61J 7/04 221/197
4,165,709 A * 8/1979 Studer ..... B65D 83/0454 116/308
4,572,403 A * 2/1986 Benaroya ..... A61J 7/04 221/15
4,725,997 A * 2/1988 Urquhart ..... A61J 7/0418 221/15
4,748,600 A * 5/1988 Urquhart ..... A61J 7/0418 221/15
4,971,221 A * 11/1990 Urquhart ..... B65D 83/0454 221/2
5,322,166 A * 6/1994 Crowther ..... B65D 83/0454 206/534
5,409,132 A * 4/1995 Kooijmans ..... A61J 7/04 221/86

(Continued)

*Primary Examiner* — Rakesh Kumar
(74) *Attorney, Agent, or Firm* — Tarolli, Sundheim, Covell & Tummino LLP

(57) ABSTRACT

An apparatus and method for dispensing medication include a medication dispensing portable communication device case. The medication dispensing portable communication device case has a device recess configured to removably hold at least a portion of a portable communication device therein. The portable communication device case has a dispensing port stoppered by a covering structure and a dial medication storage recess. The dial medication storage recess extends through a backplane of the device recess and a dial medication storage portion is held within the dial medication storage recess. The dial medication storage portion is located adjacent to the device recess. The dial medication storage portion includes a pill plate that has a plurality of individual cups, and the pill plate is placed inside a pill plate housing that is covered by an outer cover.

10 Claims, 7 Drawing Sheets

(56) References Cited

U.S. PATENT DOCUMENTS 5,755,357 A * 5/1998 Orkin ..... A61J 7/0084 221/120
6,068,126 A * 5/2000 DeJonge ..... B65D 83/0409 206/528
6,145,697 A * 11/2000 Gudish ..... A61J 7/0481 221/3
6,273,085 B1 * 8/2001 Eisele ..... A61M 15/0045 128/203.15
6,325,241 B1 * 12/2001 Garde ..... B65D 83/0454 206/533
6,364,155 B1 * 4/2002 Wolfe ..... B65D 83/0454 221/121
6,427,865 B1 * 8/2002 Stillwell ..... G07F 11/54 221/113
6,439,422 B1 * 8/2002 Papp ..... B65D 83/0454 221/13
6,601,729 B1 * 8/2003 Papp ..... A61J 7/0084 206/528
6,669,022 B2 * 12/2003 Donegan ..... A61J 7/0076 206/531
7,104,417 B2 * 9/2006 Hilliard ..... B65D 83/0454 221/25
7,360,669 B2 * 4/2008 Drajan ..... B65D 83/0409 221/208
7,543,718 B2 * 6/2009 Simon ..... A61J 7/0084 221/13
7,896,192 B2 * 3/2011 Conley ..... A61J 7/0472 221/15
8,033,422 B2 * 10/2011 Estrada ..... B65D 50/04 221/154
8,397,946 B2 * 3/2013 Portney ..... B65D 83/0454 221/113
8,976,031 B2 * 3/2015 Ophardt ..... B05B 11/308 340/573.1
9,643,770 B2 * 5/2017 Denny ..... G06F 19/3462
9,682,200 B2 * 6/2017 Denny ..... B65D 83/02
2003/0127463 A1 * 7/2003 Varis ..... A61J 7/0084 221/2
2004/0159364 A1 8/2004 Landau et al.
2005/0171477 A1 8/2005 Rubin et al.
2014/0360893 A1 * 12/2014 Whitten ..... A45C 11/00 206/45.2
2015/0080806 A1 * 3/2015 Pribitkin ..... A61M 5/2033 604/189
2015/0249478 A1 * 9/2015 Greiner ..... H04B 1/3888 455/575.8
2018/0289590 A1 * 10/2018 Graska ..... A61J 7/0076

* cited by examiner

APPARATUS AND METHOD FOR DISPENSING MEDICATION FROM A MOBILE COMMUNICATON DEVICE

TECHNICAL FIELD

This disclosure relates to an apparatus and method for dispensing medication and, more particularly, to an apparatus and method for use of a medication dispensing portable communication device case.

BACKGROUND

Pill dispensing and storage cases are commonly used by users who take daily medications. Instead of carrying a pill case containing medication throughout the day, users can now carry and store medication inside a mobile communication device case. This increases convenience for users, helping with medication compliance. When it is time for the user to receive their next dose of medication, they can dispense a pill from within the pill case held within the mobile communication device case.

SUMMARY

In an aspect, a medication dispensing portable communication device case is provided. The medication dispensing portable communication device case has
a device recess configured to removably hold at least a portion of a portable communication device therein. The portable communication device case has a dispensing port stoppered by a covering structure and a dial medication storage recess. The dial medication storage recess extends through a backplane of the device recess and a dial medication storage portion is held within the dial medication storage recess. The dial medication storage portion is located adjacent to the device recess. The dial medication storage portion includes a pill plate that has a plurality of individual cups, and the pill plate is placed inside a pill plate housing that is covered by an outer cover.

In an aspect, a medication dispensing portable communication device case is provided. The medication dispensing portable communication device case has a device recess configured to removably hold at least a portion of a portable communication device therein. The portable communication device case has a dispensing port stoppered by a covering structure. A dial medication storage recess extends through a backplane of the device recess and a dial medication storage portion is held within the dial medication storage recess. The dial medication storage portion is located adjacent to the device recess. The dial medication storage portion includes a pill plate that has a plurality of individual cups. The pill plate is placed inside a pill plate housing that is covered by an outer cover. The pill plate includes a plurality of individual cups, each individual cup configured to selectively hold at least one individual pill. The plurality of individual cups are circumferentially arranged around an outer perimeter of the pill plate. The pill plate includes a plurality of ratchet teeth interposed radially between the plurality of individual cups and the center of the pill plate. The pill plate selectively rotates within the pill plate housing. The pill plate housing includes a cylindrical wall and an opening in the cylindrical wall that selectively aligns with a selected individual cup of the pill plate. The pill plate is interposed longitudinally between the pill plate housing and the outer cover. A locating groove extends around a bottom side of the outer cover concentric with an outermost edge of the bottom side. The locating groove selectively receives a rim on the pill plate housing to engage the pill plate housing. Rotational motion of the outer cover responsively rotates the pill plate via direct force-transmitting contact between at least one protrusion on the bottom side of the outer cover and at least one ratchet tooth in the pill plate. The covering structure selectively stoppers the dispensing port.

In an aspect, a method of dispensing medication from a medication dispensing portable communication device case is provided. The medication dispensing portable communication device case removably holds at least a portion of a portable communication device in a device recess of a portable communication device case. A dispensing port associated with a dial medication storage portion is selectively exposed. An outer cover is rotated in a first direction to responsively turn the dial medication storage portion. Turning the dial medication storage portion exposes an individual pill held by the dial medication storage portion. The individual pill is removed from the dial medication storage portion from the exposed dispensing port. The dispensing port is selectively stoppered with a covering structure.

BRIEF DESCRIPTION OF THE DRAWINGS

For a better understanding, reference may be made to the accompanying drawings, in which.

DESCRIPTION OF ASPECTS OF THE DISCLOSURE

Unless defined otherwise, all technical and scientific terms used herein have the same meaning as is commonly understood by one of skill in the art to which the present disclosure pertains.

As used herein, the term "user" can be used interchangeably to refer to an individual who prepares for, assists, and performs, and/or receives a medication or supplement.

As used herein, the singular forms "a," "an" and "the" can include the plural forms as well, unless the context clearly indicates otherwise. It will be further understood that the terms "comprises" and/or "comprising," as used herein, can specify the presence of stated features, steps, operations, elements, and/or components, but do not preclude the presence or addition of one or more other features, steps, operations, elements, components, and/or groups thereof.

As used herein, the term "and/or" can include any and all combinations of one or more of the associated listed items.

It will be understood that when an element is referred to as being "on," "adjacent" to, "received" by, etc., another element, it can be adjacent to, directly on, attached to, connected to, coupled with or contacting the other element or intervening elements may also be present.

It will be understood that, although the terms "first," "second," etc. may be used herein to describe various elements and/or directions, these elements and/or directions should not be limited by these terms. These terms are only used to distinguish one element and/or direction from another. Thus, a "first" element and/or direction discussed below could also be termed a "second" element and/or direction without departing from the teachings of the present disclosure. The sequence of operations (or steps) is not limited to the order presented in the claims or figures unless specifically indicated otherwise.

It will be understood that when an element is referred to as moving or turning a first direction or second direction this refers to rotational motions about an axis, and can mean either clockwise or counterclockwise.

The invention comprises, consists of, or consists essentially of the following features, in any combination.

Figure 1:
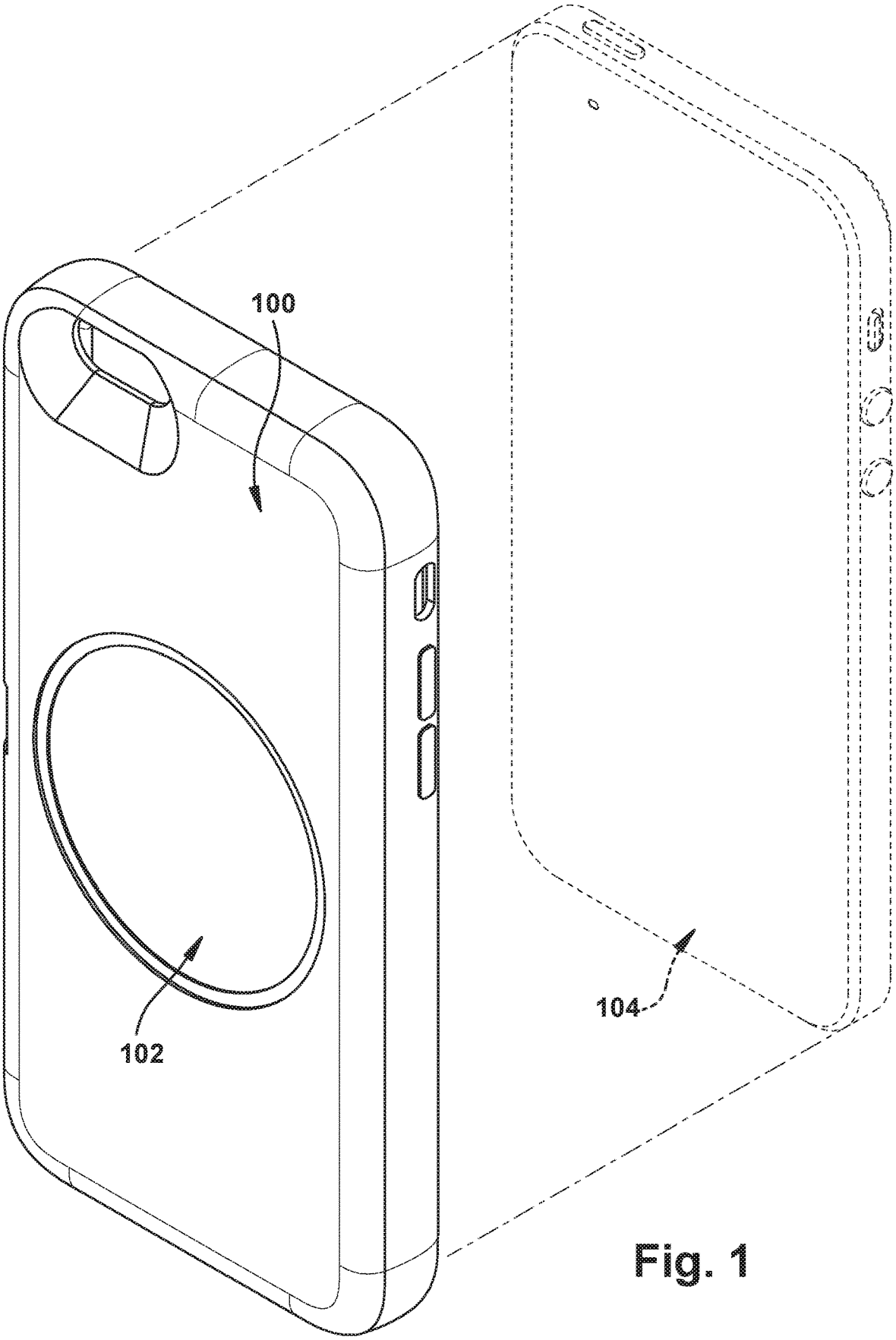
FIG. 1 is an exploded rear perspective view of a medication dispensing portable communication device case according to one aspect of the present invention.
Figure 2:
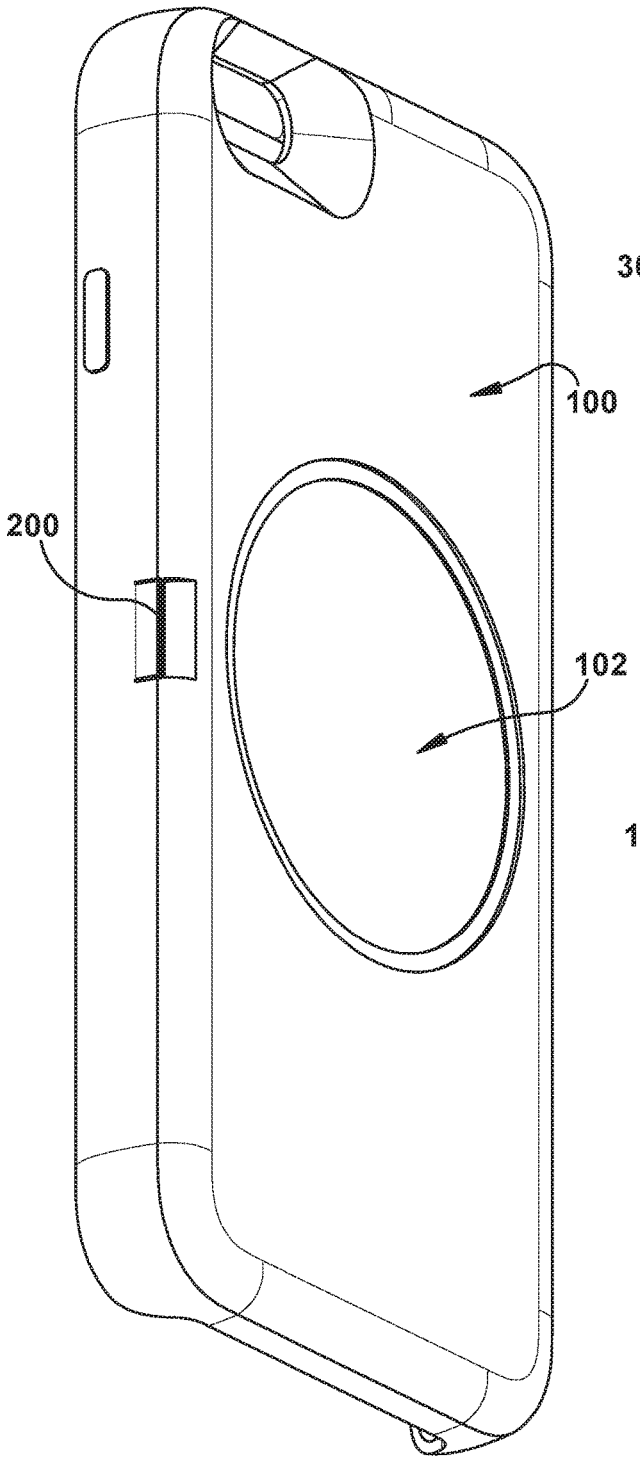
FIG. 2 is a rear perspective view of the medication dispensing portable communication device of the aspect of FIG. 1.

FIGS. 1-2 and 7-8 depict a medication dispensing portable communication device case 100. The medication dispensing portable communication device case 100 has an aperture 102 extending through an outside of the medication dispensing portable communication device case 100. As shown in FIG. 2, a dispensing port 200 is located in the outside of the medication dispensing portable communication device case 100. The dispensing port 200 is an opening on the side of the portable communication device case 100.

The medication dispensing portable communication device case 100 may be at least partially formed from at least one of rubber, Styrofoam, polyurethane foam, plastics, polymers, resins, polycarbonate, alloys, carbon fiber, fiberglass, polyethylene foam, or any other desired material or combination of materials. Individual pills to be placed within the pill plate 400 can be any type of pill, including, but not limited to, pills for birth control, cardiac management pills, pills prescribed for a user, pills regularly taken by a user, vitamins, blood pressure medication, allergy medication, pain medication, thyroid medication, other pharmaceuticals, or the like. The pills can be for everyday use, pills to be taken multiple times a day, or just pills to keep on hand for use on an as-needed basis.

As used herein, the terms "pill" and "medication" are used interchangeably to refer to a medication, pill, or any other dispensed item due to the large variety of potential options.

Figure 3:
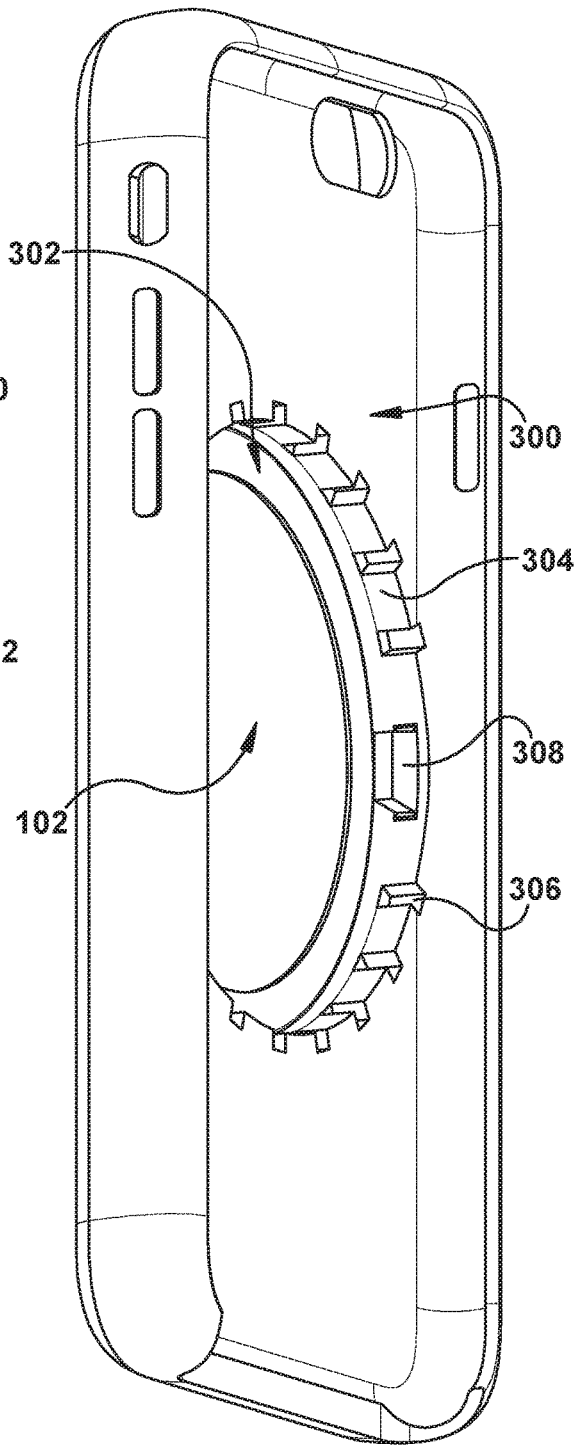
FIG. 3 is a front perspective view of the medication dispensing portable communication device of the aspect of FIG. 1.

FIG. 3 depicts a medication dispensing portable communication device case 100. The medication dispensing portable communication device case 100 has a device recess 300 configured to removably hold at least a portion of a portable communication device 104 therein. The portable communication device may be a mobile phone, a smartphone, a personal digital assistant, a pager, a tablet, any portable computing device, any other suitable communication device, or any combination thereof. For example, a specific medication dispensing portable communication device case 100 could be configured to accept/hold a particular make and model of smartphone.

As shown in FIG. 3, a dial medication storage recess 302 is an aperture extending from the device recess 300 longitudinally through to an outside of the portable communication device case 100. The term "longitudinally" is used herein to indicate a direction substantially perpendicular to a backplane of the portable communication device case 100 (i.e., substantially perpendicular to the front screen of a smartphone, for example, held within the device recess 300 of the portable communication device case 100). The aperture 102 exposes a portion of a dial medication storage portion to ambient space outside of the medication dispensing portable communication device case 100. The dial medication storage recess 302 includes an indented ridge 304 surrounding the aperture 102 with at least one notch 306 extending radially from the aperture 102 into the indented ridge 304 which receives the dial medication storage portion. The term "radially" is used herein to indicate a direction which is substantially perpendicular to the longitudinal direction—e.g., the radial direction is within the plane of the page, in the orientation of FIG. 4A. The at least one notch 204 serves to keep the dial medication storage portion in place during rotation. As depicted in FIG. 3, the dispensing port 200 may be covered by a covering structure 308. The covering structure 308 at least partially enters the dispensing port 200 in the portable communication device case 100 through an opening in a cylindrical wall 504 of the pill plate housing 500, and the covering structure is received by a selected individual cup in the pill plate 400 to selectively resist rotational movement of the pill plate 400 within the pill plate housing 500. The dial medication storage portion is larger in at least one dimension than the dial medication storage recess 302 such that placement of the dial medication storage portion, within the dial medication storage recess 302, located between the portable communication device case 100 and the portable communication device 104 at least partially prevents the dial medication storage portion from exiting the dial medication storage recess 302.

Figure 4A:
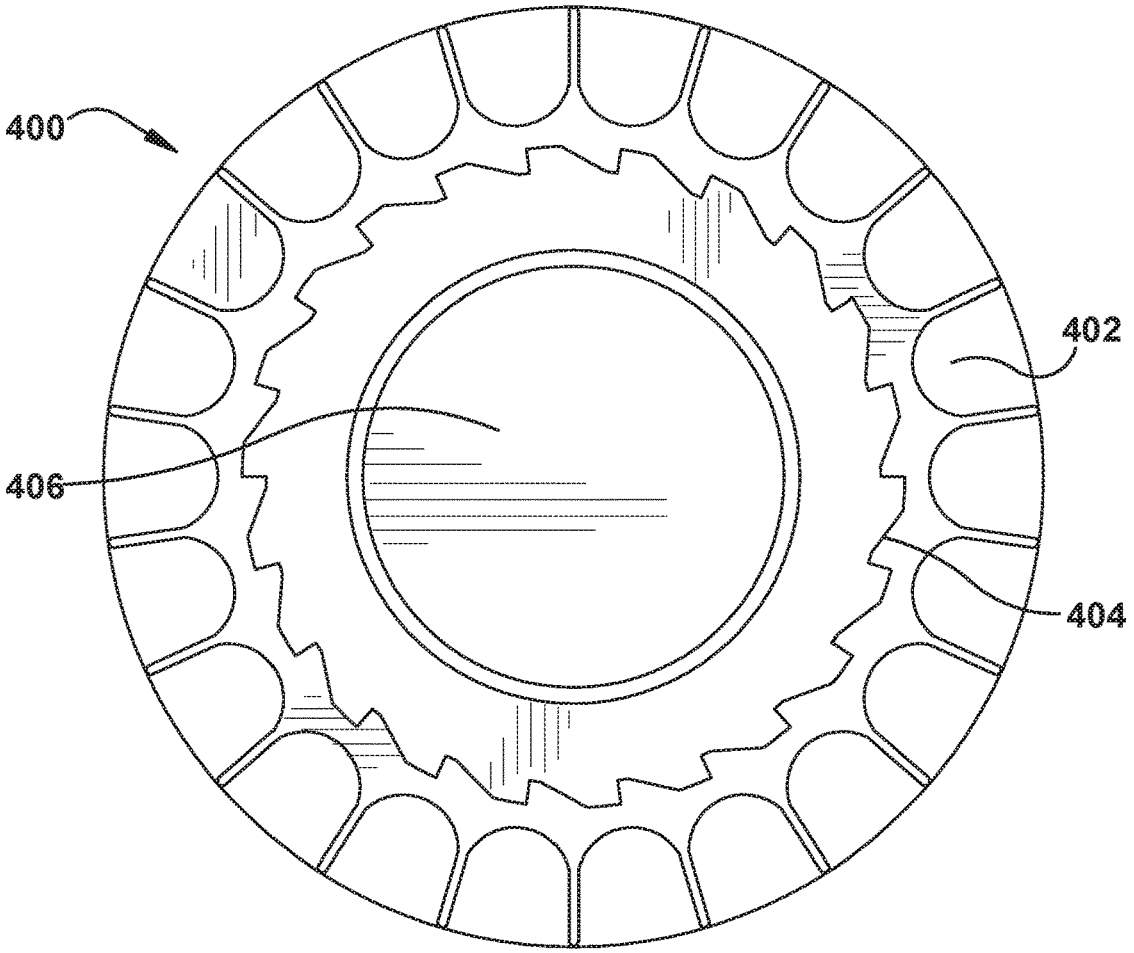
FIG. 4A is a top view of a component of the aspect of FIG. 1.
Figure 4B:
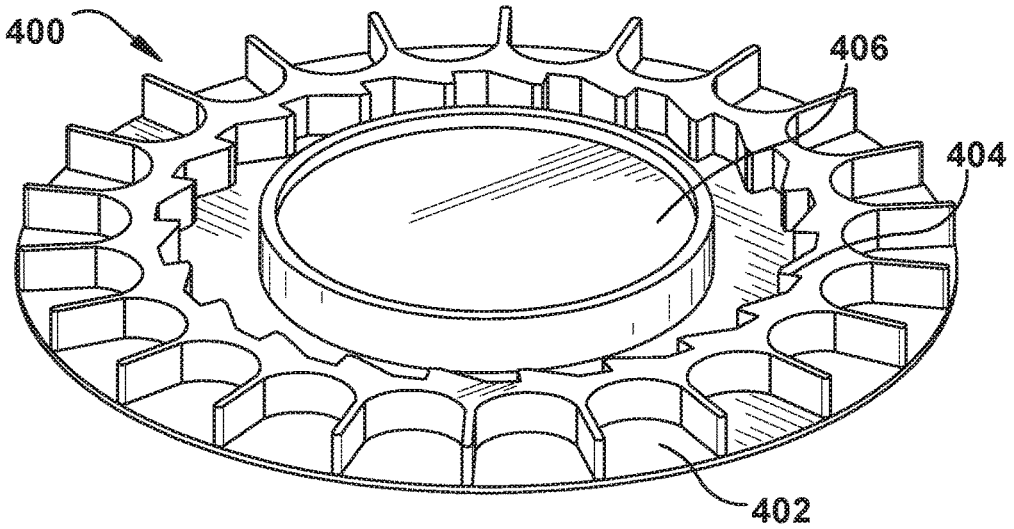
FIG. 4B is a perspective view of the component of FIG. 4A.

FIGS. 4A-4B depict a pill plate 400 including a plurality of individual pill cups 402 circumferentially arranged around an outer perimeter of the pill plate 400. Each individual cup 402 is configured to selectively hold at least one individual pill. A plurality of ratchet teeth 404 are interposed radially between the plurality of individual pill cups 402 and a center (e.g., the center "+" of the circle) of the pill plate 406. The pill plate 400 can selectively rotate within the pill plate housing 500.

The ratchet teeth 404 are arranged to permit rotation of the pill plate 400 in a first direction (e.g., clockwise, in the orientation of FIG. 4A) and to resist rotation of the pill plate 400 in a second direction, opposite the first direction (e.g., counterclockwise, in the orientation of FIG. 4A). For example, the ratchet teeth 404 could allow the pill plate 400 to rotate clockwise, but the ratchet teeth 404 would prevent the pill plate 400 from turning counterclockwise. This may be helpful in allowing a user to monitor or control which individual pill cup 402 is being accessed at a particular time. Such monitoring or control may be desirable, for example, in the event that different daily pills are taken over the course of an extended period of days.

Figure 5A:
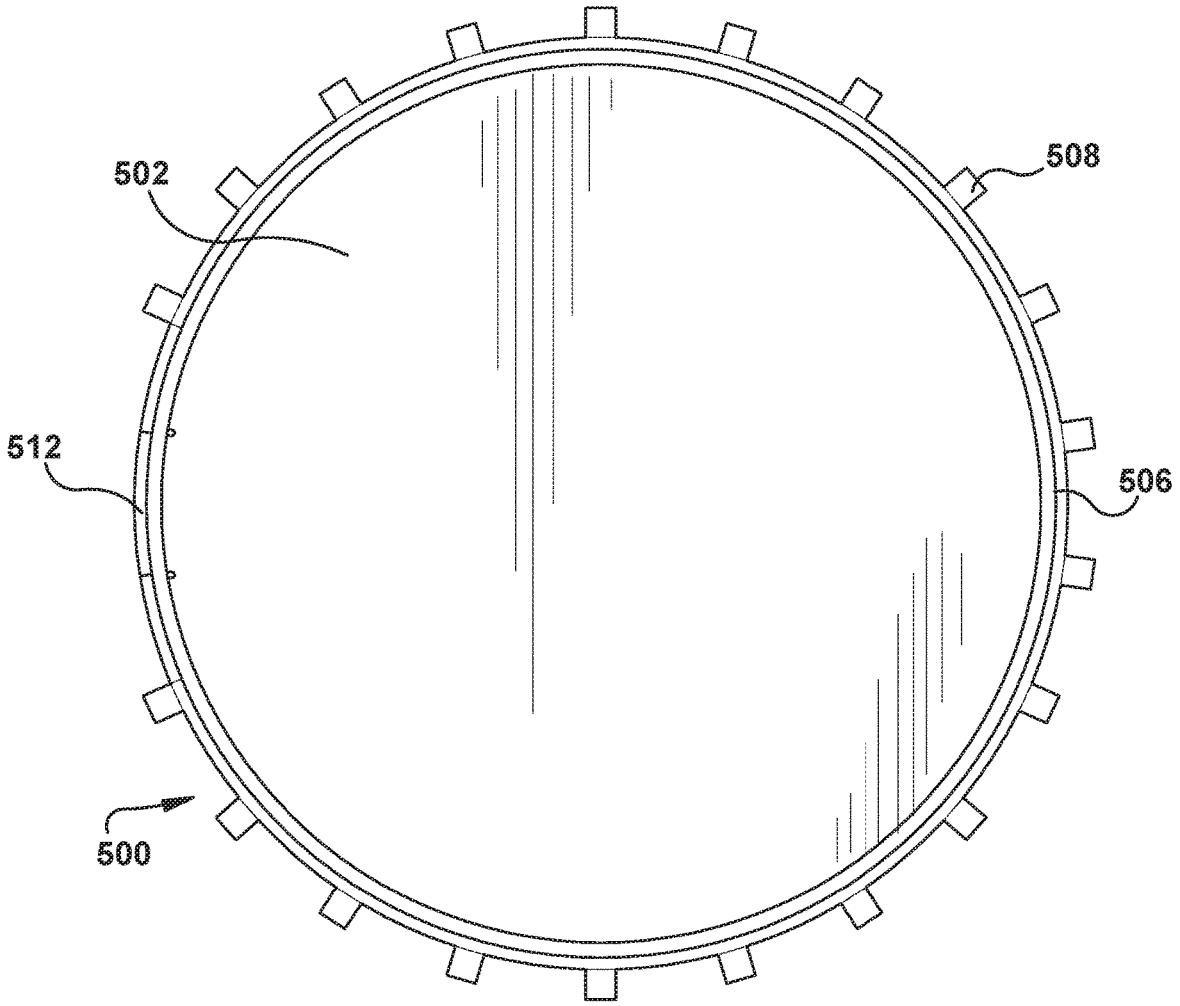
FIG. 5A is a top view of a component of the aspect of FIG. 1.
Figure 5B:
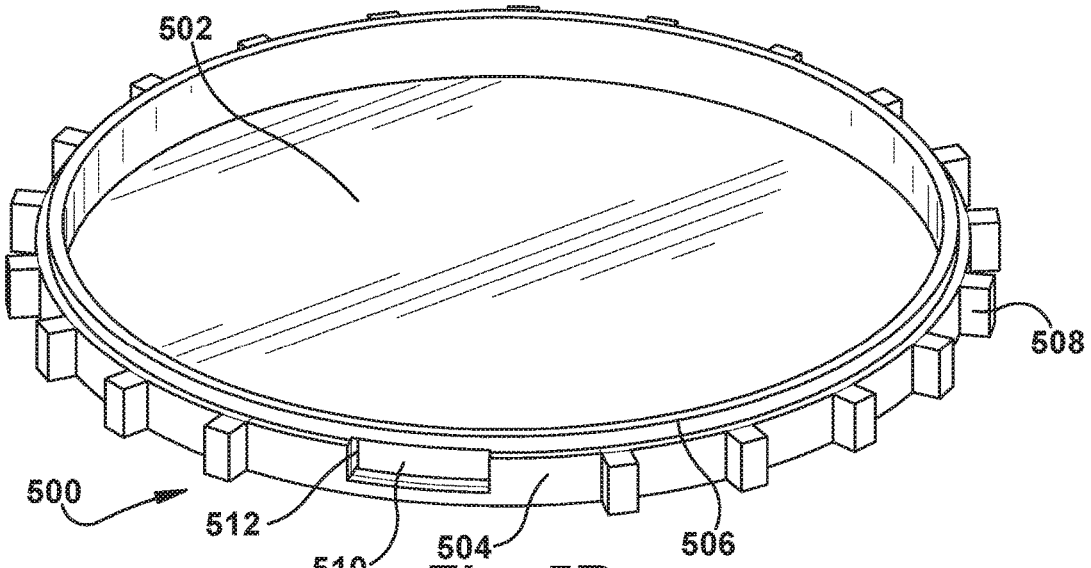
FIG. 5B is a perspective view of the component of FIG. 5A.

FIGS. 5A-5B depict a pill plate housing 500 including a circular base 502, a cylindrical wall 504 and a rim 506. The cylindrical wall 504 projects from an outermost edge of the circular base 502 and the rim 506 sits on top of the cylindrical wall 504. At least one protrusion 508 projects from an outermost edge of the cylindrical wall 504, and an opening 510 is present in the cylindrical wall 504 of the pill plate housing 500. At least one post 512 protrudes inward from either side of the opening 510 in the cylindrical wall 504 of the pill plate housing 500. The at least one post 512 abuts and slides past the plurality of individual cups 402 in the pill plate 400 to indicate alignment of each individual cup with the dispensing port 200. In other words, the sliding of the individual cup 402 past the post(s) may create a tactile and/or audible signal (e.g., a "click") that indicates that a desired individual cup 402 has reached the dispensing port and the cup's contents can be removed.

The pill plate housing 500 may be at least partially formed from at least one of Styrofoam, polyurethane foam, polyethylene foam, polymers, plastics, resins, or any other desired material or combination of materials.

Figure 6A:
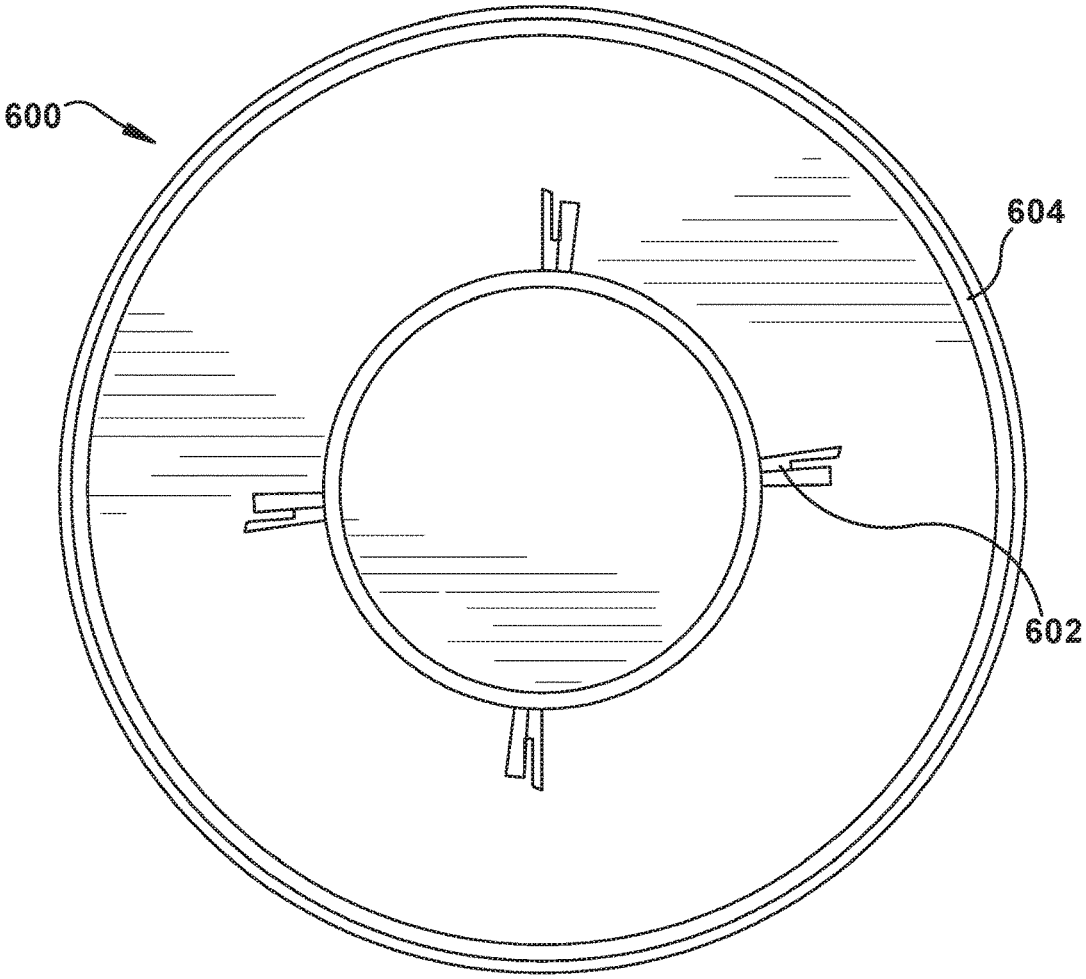
FIG. 6A is a bottom view of a component of the aspect of FIG. 1.
Figure 6B:
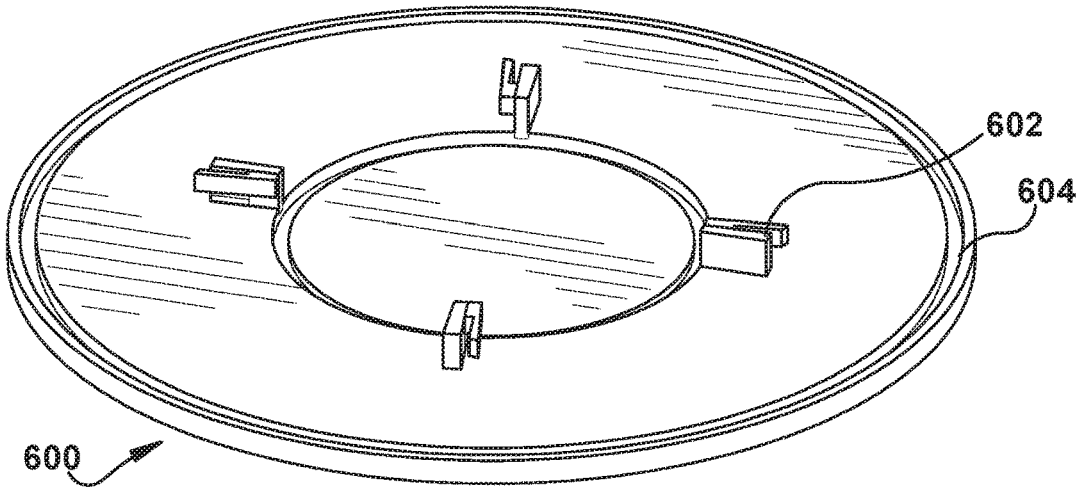
FIG. 6B is a perspective view of the component of FIG. 6A.
Figure 7:
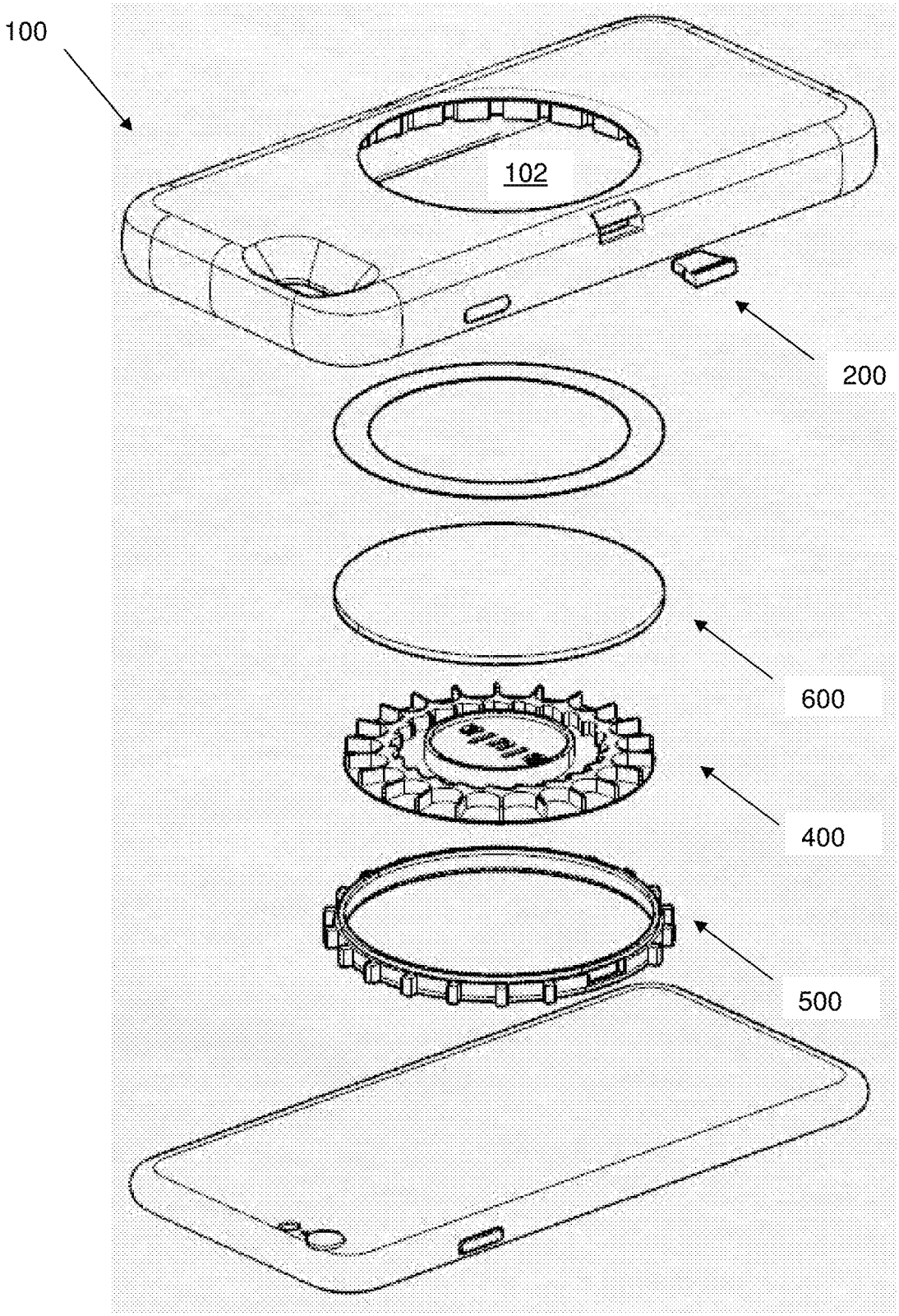
FIG. 7 is an exploded top view of the aspect of FIG. 1.
Figure 8:
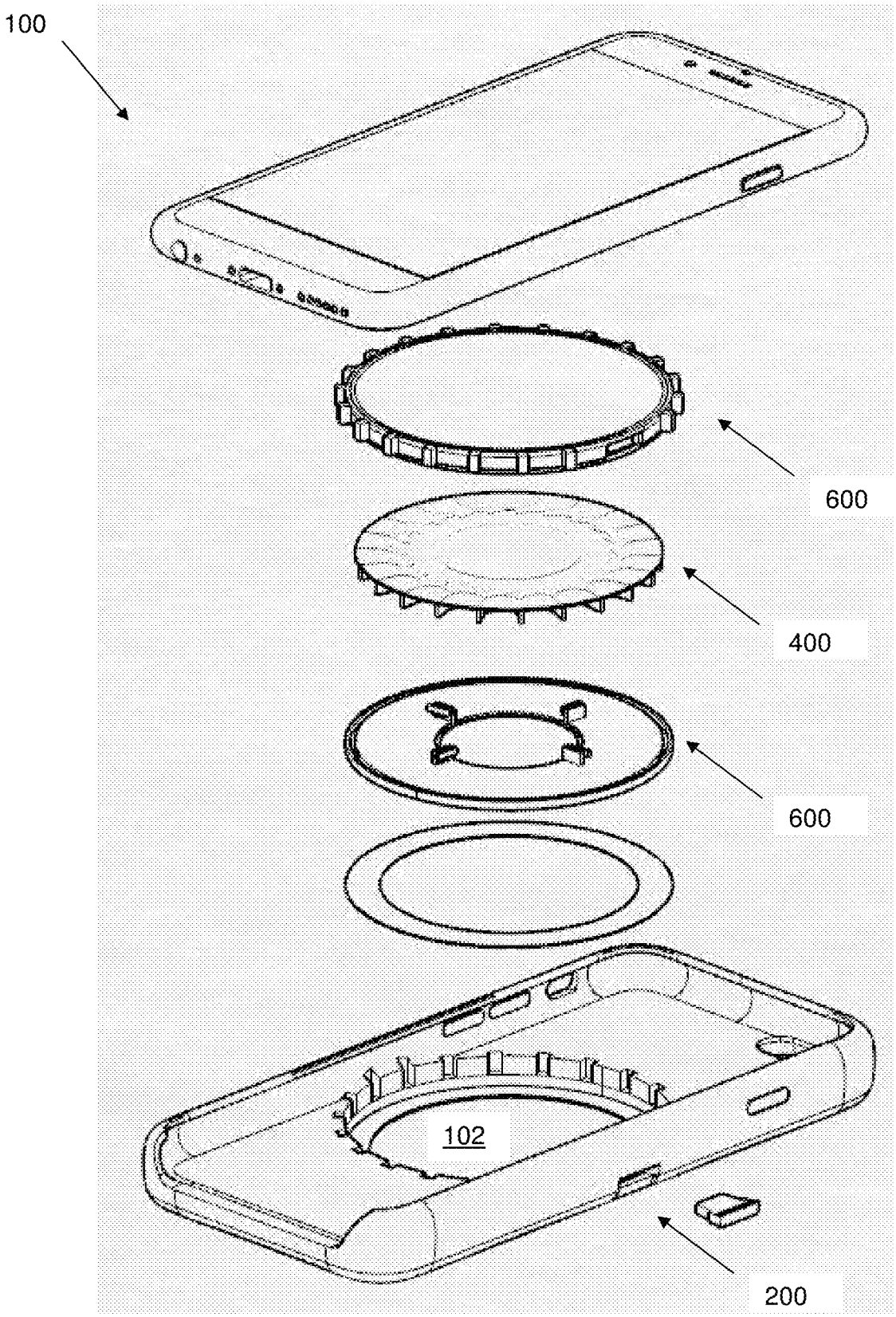
FIG. 8 is an exploded bottom view of the aspect of FIG. 1.

FIGS. 6A-6B depict an outer cover 600 that has at least one protrusion 602 on a bottom side and a locating groove 604 around an outermost edge of the bottom side. The at least one protrusion 602 of the outer cover 600 selectively ratchets with at least one of the plurality of ratchet teeth 404 in the pill plate 400. The rim 506 of the pill plate housing 500 is received into the locating groove 604 of the outer cover 600.

The outer cover 600 may be at least partially formed from at least one of plastics, polymers, rubbers, polycarbonate, alloys, carbon fiber, Styrofoam, polyurethane foam, polyethylene foam, or any other desired material or combination of materials.

The dial medication storage portion assembly involves the combination of the pill plate 400, the pill plate housing 500, and the outer cover 600. The pill plate 400 fits into the pill plate housing 500 and is interposed longitudinally between the pill plate housing 500 and the outer cover 600. The outer cover 600 is attached to the pill plate housing 500. The rim 506 of the pill plate housing 500 is selectively received by the locating groove 604, which extends around a bottom side of the outer cover 600 concentric with an outermost edge of the bottom side, to engage the pill plate housing 500. In other words, the pill plate 400 is set inside the pill plate housing 500, and then the outer cover 600 attaches onto the rim 506 of the pill plate housing 500 to form the dial medication storage portion. At least one protrusion 602 on the bottom side of the outer cover 600 selectively engages with the plurality of ratcheting teeth 404 in the pill plate 400. In other words, the at least one protrusion 602 on the bottom side of the outer cover 600 helps attach the outer cover 600 to the pill plate 400 by interlocking with the plurality of ratcheting teeth 404. Rotational motion of the outer cover 600 responsively rotates the pill plate 400 via direct force-transmitting contact between the at least one protrusion 602 on the bottom side of the outer cover 600 and the at least one ratchet tooth in the pill plate 400. The user rotates the outer cover 600 with her fingers, which in turn rotates the pill plate to bring each of the plurality of individual pill cups 402 to the dispensing port 200.

The dial medication storage portion is placed into the dial medication storage recess 302 such that the outer cover 600 abuts the aperture 102 with the opening 510 of the pill plate housing 500 selectively aligned with the dispensing port 200. In other words, a portion of the outer cover 500 of the dial medication storage portion is exposed to the outside of the portable communication device case 100 for the user to rotate. At least one protrusion 508 on the outermost edge of the cylindrical wall 504 of the pill plate housing 500 is selectively received by at least one notch 306 of the dial medication storage recess 302. The dial medication storage recess 302 extends through a backplane of the device recess 300 and the dial medication storage portion is held within the dial medication storage recess 302, which is located adjacent to the device recess 300. In other words, the dial medication storage portion fits into the dial medication storage recess 302, and the at least one protrusion 508 and the at least one notch 306 ensure that the dial medication storage portion as a whole will remain in place within the portable communication device case 100 when in use.

The covering structure 308 is selectively inserted into the dispensing port 200. The covering structure 308 may be in the form of a plug, a flap, a sliding door, a hinged door, a tab, or any other desired covering structure configuration. The covering structure 308 shown in the Figures traverses the opening 510 of the pill plate housing 500 and fills an individual pill cup 402 of the pill plate 400, stoppering the dial medication storage portion and preventing it from spinning freely. In other words, the covering structure 308 may be used to prevent individual pills from falling out of the portable communication device case 100 and may also be used to prevent the pill plate 400 from spinning freely within the dial medication storage portion—again, potentially desirable when the pills carried within the portable communication device case 100 are not all the same.

A mobile communication device 104 is selectively received by the device recess 300. From the outside of the medication dispensing portable communication device case 100, rotating the outer cover 600 through the aperture 102 responsively rotates the pill plate 400 via direct force-transmitting contact between the at least one protrusion 602 on the bottom side of the outer cover 600 and at least one of the plurality of ratchet teeth 404 in the pill plate 400.

In use, the user inserts at least a portion of a portable communication device 104 in a device recess 300 of a medication dispensing portable communication device case 100. Individual pills are placed within the pill plate 400 in the pill plate housing 500, which are encompassed in the dial medication storage portion.

To receive an individual pill from the medication dispensing portable communication device case 100, the user removes a covering structure 308 to selectively expose a dispensing port 200 associated with the dial medication storage portion. Then, the user rotates an outer cover 600 a first direction to responsively turn the dial medication storage portion, exposing an individual pill held within the pill plate 400 of the dial medication storage portion. Next, the user removes the individual pill from the dial medication storage portion from the exposed dispensing port 200 (e.g., by shaking or tilting the portable communication device case 100). Finally, the user selectively stoppers the dispensing port 200 with a covering structure 308 to cover the dispensing port 200 and also potentially to resist rotation of the pill plate 400 until the next use event.

To load the medication dispensing portable communication device case 100, the user first places a pill plate 400, with a plurality of individual cups 402 facing the outer cover 600, into a pill plate housing 500. Next, the user provides at least one individual pill and inserts at least one pill into an empty individual pill cup 402, creating a first full individual pill cup. Then, the user sequentially inserts one individual pill into each of at least one other empty individual pill cups to create other full individual pill cups. An individual pill cup may be left empty in order to be filled by the covering structure 308 to "index" a sequence of pills, prevent the pill plate's 400 rotation during storage, and/or for any other desired reason. Next, the user places the outer cover 600 onto the pill plate housing 500 such that a rim 506 is received by a locating groove 604 to create a dial medication storage portion. Then, the dial medication storage portion, with a top of the outer cover 600 facing the aperture 102, is placed into the dial mediation storage recess 302 with the opening 510 in the cylindrical wall 504 of the pill plate housing 500 lining up with the dispensing port 200. The user then stoppers the dispensing port 200 with the covering structure 308, and the dial medication storage portion is held in the dial medication storage recess 302 via presence of the portable communication device within the device recess 300. Stated differently, a user first places the pill plate 400 into the pill plate housing 500. The user places individual pills into each individual pill cup in the pill plate 400, optionally leaving one pill cup empty. Next, the user attaches the outer cover 600 onto the rim 506 of the pill plate housing 500, completing the dial medication storage portion. The dial medication storage portion is then placed into the dial medication storage recess 302 with the top of the outer cover 600 facing the aperture 510. The covering structure 308 stoppers the dispensing port 200, preventing individual pills from falling out, and may also prevent the pill plate 400 from spinning freely within the dial medication storage portion. Finally, the user places the portable communication device 104 into the device recess, which holds the dial medication storage portion in place.

It is contemplated that the dial medication storage portion can be reset and reused after all the pills are initially used. The user simply takes apart the medication dispensing portable communication device case 100 and the dial medication storage portion and reloads the pill plate 400 with new pills. First, the user removes the portable communication device from the device recess 300. Next, the user pushes out the dial medication storage portion from the dial medication storage recess 302. Then, the user removes the outer cover 600 from the pill plate housing 500, exposing the pill plate 400. Next, the user refills the individual pill cups 402 with individual pills. Finally, the user reassembles the dial medication storage portion in the reverse order, places it into the dial medication storage recess 302, and then puts the portable communication device into the device recess 300.

Rotating the outer cover 600 in a first direction responsively rotates the pill plate 400. A wall of an individual cup 402 in the pill plate 400 presses against, and slides past, at least one post 512. The at least one post protrudes inward on either side of the opening 510 in the cylindrical wall 504 of the pill plate housing 500. The at least one post 512 causes the next individual pill cup to become aligned with the opening 510.

The dial medication storage portion is placed in electronic communication with the portable communication device 104. The portable communication device 104 may electronically communicate a medication event from the dial medication storage portion to the portable communication device 104 to selectively notify a user of the medication event. The medication event may be at least one of the following: notifying the user that it is time to take an individual pill; notifying the user of a need to refill a prescription; tracking a user's menstrual cycle; creating and/or maintaining user profile(s); handling various calendaring functions; notifying the user that the prescription is ready for the user to retrieve; notifying the user that a planned individual pill dosage was missed, or any other desired occurrence (or lack of occurrence) related to the user's use of the pills. In other words, the dial mediation storage portion may be compatible and fully integrated with the portable communication device 104. A portable communication device application (e.g., a "smartphone app") may allow users to, for example, set daily reminders as to when medication should be taken; see how many individual pills remain in the dial medication storage portion; notify a prescribed pharmacy when to refill a certain prescription; notify users when a new prescription needs to be ordered; provide social networking capabilities; provide educational material, or be used in any other way to facilitate a user's compliance with a desired pill regimen.

The medication dispensing portable communication device case 100 may connect with the portable communication device via electronic communication. For example, a computer chip, RFID tag, sensor, sensor-detectable material (e.g., a magnet), or any other desired feature (hereafter, "communication feature") to assist with communicating information on the pill or pill plate status could be integrated into the medication dispensing portable communication device case 100 and link to a mobile application installed on a user's portable communication device 104 or to some other monitoring or communication device (e.g., a nurses' office computer serving as a pill-regimen compliance monitor). At least one sensor integrated into the medication dispensing portable communication device case 100 may relays information to the communication feature. The information may be received by the user on the portable communication device 104 via the established link between the communication feature and the mobile application installed on the portable communication device 104. The communication feature and portable communication device 104 may connect via Bluetooth, WIFI, Zigbee, RFID, USB or other download cord/link (e.g., via a headphone jack or charging port on the portable communication device 104), and/or by other wireless or wired communication technologies. The communication feature and at least one sensor may be powered by a battery or by obtaining power from the portable communication device 104.

While aspects of this disclosure have been particularly shown and described with reference to the example aspects above, it will be understood by those of ordinary skill in the art that various additional aspects may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. In an effort to maintain clarity in the Figures, certain ones of duplicative components shown have not been specifically numbered, but one of ordinary skill in the art will realize, based upon the components that were numbered, the element numbers which should be associated with the unnumbered components; no differentiation between similar components is intended or implied solely by the presence or absence of an element number in the Figures. The description of each element number whether including an "a," "b," or neither, is intended to describe all like elements with the same numbering. For example, the description of element 111 describes 111, 111*a*, and/or 111*b*. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking potentially aiding a user in selecting one component from an array of similar components for a particular use environment. The term "substantially" is used herein to indicate a quality that is largely, but not necessarily wholly, that which is specified—a "substantial" quality admits of the potential for some relatively minor inclusion of a non-quality item. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

We claim:

1. A medication dispensing portable communication device case, comprising:

a portable communication device case having a device recess configured to removably hold at least a portion of a portable communication device therein;

the portable communication device case having a dispensing port stoppered by a covering structure; and a dial medication storage recess, extending through a backplane of the device recess, a dial medication storage portion held within the dial medication storage recess, located adjacent to the device recess, the dial medication storage portion including a pill plate, the pill plate having a plurality of individual cups, and the pill plate being placed inside a pill plate housing covered by an outer cover;

wherein the dial medication storage recess is an aperture extending from the device recess through to an outside of the portable communication device case exposing a portion of the dial medication storage portion to ambient space outside the portable communication device case; and wherein the dial medication storage recess includes an indented ridge surrounding the aperture, and at least one notch extending radially from the aperture into the indented ridge that receives the dial medication storage portion, the notch serving to keep the dial medication storage portion in place during rotation.

2. The medication dispensing portable communication device case of claim 1, wherein the dispensing port is an opening on the side of the portable communication device case for selectively receiving the covering structure.

3. The medication dispensing portable communication device case of claim 2, wherein the covering structure at least partially enters the dispensing port in the portable communication device case through an opening in a cylindrical wall of the pill plate housing, and the covering structure is received by a selected individual cup in the pill plate to selectively resist rotational movement of the pill plate within the pill plate housing.

4. The medication dispensing portable communication device case of claim 1, wherein the dial medication storage portion is larger in at least one dimension than the dial medication storage recess such that placement of the dial medication storage portion, within the dial medication storage recess, located between the portable communication device case and the portable communication device at least partially prevents the dial medication storage portion from exiting the dial medication storage recess.

5. The medication dispensing portable communication device case of claim 4, wherein the pill plate includes the plurality of individual cups circumferentially arranged around an outer perimeter of the pill plate and a plurality of ratchet teeth interposed radially between the plurality of individual cups and a center of the pill plate.

6. The medication dispensing portable communication device case of claim 5, wherein the pill plate housing includes a circular base, a cylindrical wall projecting from an outermost edge of the circular base, at least one protrusion projecting from an outermost edge of the cylindrical wall, an opening in the cylindrical wall of the pill plate housing, and a rim on an outermost edge of the pill plate housing.

7. The medication dispensing portable communication device case of claim 6, wherein at least one post protrudes inward from either side of the opening in the cylindrical wall of the pill plate housing, the at least one post abutting and sliding past the plurality of individual cups in the pill plate to indicate alignment of each individual cup with the dispensing port.

8. The medication dispensing portable communication device case of claim 7, wherein the outer cover has at least one protrusion on a bottom side and a locating groove around an outermost edge of the bottom side.

9. Medication dispensing portable communication device case of claim 8, wherein at least one protrusion of the outer cover selectively ratchets with at least one of the plurality of ratchet teeth in the pill plate, and the rim of the pill plate housing is received into the locating groove of the outer cover.

10. The medication dispensing portable communication device case of claim 9, wherein the pill plate is received in the pill plate housing, the outer cover locating groove engages with the rim of the pill plate housing, the at least one protrusion projecting from the outermost edge of the cylindrical wall of the pill plate housing inserts into at least one notch in the dial medication storage recess that receives the dial medication storage portion, and the dial medication storage portion abuts the aperture.

* * * * *